US011666152B2

(12) United States Patent
Hale et al.

(10) Patent No.: US 11,666,152 B2
(45) Date of Patent: Jun. 6, 2023

(54) FOLDING CHAIR

(71) Applicant: Backyard Nature Products, Chilton, WI (US)

(72) Inventors: Ryan Hale, Chilton, WI (US); David Demarco, Chilton, WI (US)

(73) Assignee: Backyard Nature Products, LLC, Chilton, WI (US)

( * ) Notice: Subject to any disclaimer, the term of this patent is extended or adjusted under 35 U.S.C. 154(b) by 29 days.

(21) Appl. No.: 17/368,556

(22) Filed: Jul. 6, 2021

(65) Prior Publication Data

US 2022/0007838 A1 Jan. 13, 2022

Related U.S. Application Data

(60) Provisional application No. 63/048,971, filed on Jul. 7, 2020.

(51) Int. Cl.
*A47C 4/24* (2006.01)

(52) U.S. Cl.
CPC ..... *A47C 4/24* (2013.01)

(58) Field of Classification Search
CPC ..... A47C 4/14; A47C 4/24
USPC ..... 297/55, 56, 57
See application file for complete search history.

(56) References Cited

U.S. PATENT DOCUMENTS 714,562 A * 11/1902 Crandall et al. ..... A47C 4/24 297/57
1,979,562 A * 11/1934 Morgan ..... A47C 4/14 108/116
1,989,864 A * 2/1935 Jaworowski ..... F04C 18/352 418/241
2,873,793 A * 2/1959 Garcia ..... A47C 4/14 297/57
3,220,764 A * 11/1965 Duer ..... A47C 4/24 108/120
5,588,695 A * 12/1996 Gomes ..... A47C 7/664 297/410
2003/0184132 A1* 10/2003 Adams ..... A47C 4/14 297/56

* cited by examiner

*Primary Examiner* — Sarah B McPartlin

(57) ABSTRACT

Various embodiments of the present disclosure relate to folding furniture, and more specifically, to folding chairs with the ability to support their own weight and stand while in a folded position. In an embodiment, a folding chair configurable in an unfolded position and a folded position comprises a first leg assembly, a second leg assembly, a seat, and a chair back fixed between the first and second leg assemblies. The first and second leg assemblies each comprise an outer leg pivotally coupled with an inner leg, such that in the folded or unfolded positions, the first and second leg assemblies support the folding chair. The seat comprises a support bar and is pivotally coupled with each inner leg of the first and second leg assemblies, such that in the unfolded position, the seat provides support for a person when the support bar contacts a portion of the first outer leg and a portion of the second outer leg preventing overextension of the seat. In the folded position, the seat lies perpendicularly with the ground and provides a counterweight to allow the folding chair to stand on the first leg assembly and second leg assembly.

20 Claims, 9 Drawing Sheets

FOLDING CHAIR

RELATED APPLICATIONS

This application hereby claims the benefit of and priority to U.S. Provisional Patent Application No. 63/048,971, titled "FOLDING CHAIR," filed Jul. 7, 2020, which is hereby incorporated by reference in its entirety.

TECHNICAL FIELD

Aspects of the disclosure are related to the field of furniture and folding chairs.

BACKGROUND

Folding chairs have been used for a long period of time for temporary seating, patio seating, stadium seating, and more. Folding chairs have the advantage of being storable while in a folded position allowing users to put the chairs elsewhere when not in use. Thus, the folded position provides for a compact configuration for stacking, hanging, or some other method of storage. When in an open or unfolded position, folding chairs support the weight of a person with a seat and seatback to allow the person to lean back comfortably in the seat.

Folding chairs, however, have inherent flaws to accommodate for temporal seating and storage uses. Some disadvantages include but are not limited to lack of durability, discomfort, poor folding and/or storage capabilities, and weight issues, among other disadvantages. For example, some folding chairs are too light and flimsy thus causing the chair to inadvertently fold when a person is seated or trying to move the chair while in a seated position. On the other hand, some folding chairs weigh too much and/or require great force to open or fold the chair, defeating the purpose of an easily maneuverable and storable chair. Further, to store folding chairs, racks, crates, hangers, or the like are required to gather the folding chairs together or to prevent the chairs from falling when upright. What is needed is not only an improvement to folding chair design and durability, but also storage ability to eliminate the use of bulky racks or storage devices.

OVERVIEW

Various embodiments of the present disclosure relate to folding furniture, and more specifically, to folding chairs with the ability to support their own weight and stand while in a folded position.

In an embodiment, a folding chair configurable in an unfolded position and a folded position comprises a first leg assembly, a second leg assembly, a seat, and a chair back fixed between the first and second leg assemblies. The first and second leg assemblies each comprise an outer leg pivotally coupled with an inner leg, such that in the folded or unfolded positions, the first and second leg assemblies support the folding chair. The seat comprises a support bar and is pivotally coupled with each inner leg of the first and second leg assemblies, such that in the unfolded position, the seat provides support for a person when the support bar contacts a portion of the first outer leg and a portion of the second outer leg preventing overextension of the seat. In the folded position, the seat lies perpendicularly with the ground and provides a counterweight to allow the folding chair to stand on the first leg assembly and second leg assembly.

This Overview is provided to introduce a selection of concepts in a simplified form that are further described below in the Detailed Description. This Overview is not intended to identify key features or essential features of the claimed subject matter, nor is it intended to be used as an aid in determining the scope of the claimed subject matter.

While multiple embodiments are disclosed, still other embodiments of the present technology will become apparent to those skilled in the art from the following detailed description, which shows and describes illustrative embodiments of the invention. As will be realized, the technology is capable of modifications in various aspects, all without departing from the scope of the present invention. Accordingly, the drawings and detailed description are to be regarded as illustrative in nature and not restrictive.

BRIEF DESCRIPTION OF THE DRAWINGS

Many aspects of the disclosure can be better understood with reference to the following drawings. The components in the drawings are not necessarily drawn to scale. Moreover, in the drawings, like reference numerals designate corresponding parts throughout the several views. While several embodiments are described in connection with these drawings, the disclosure is not limited to the embodiments disclosed herein. On the contrary, the intent is to cover all alternatives, modifications, and equivalents.

DETAILED DESCRIPTION

Figure 1A:
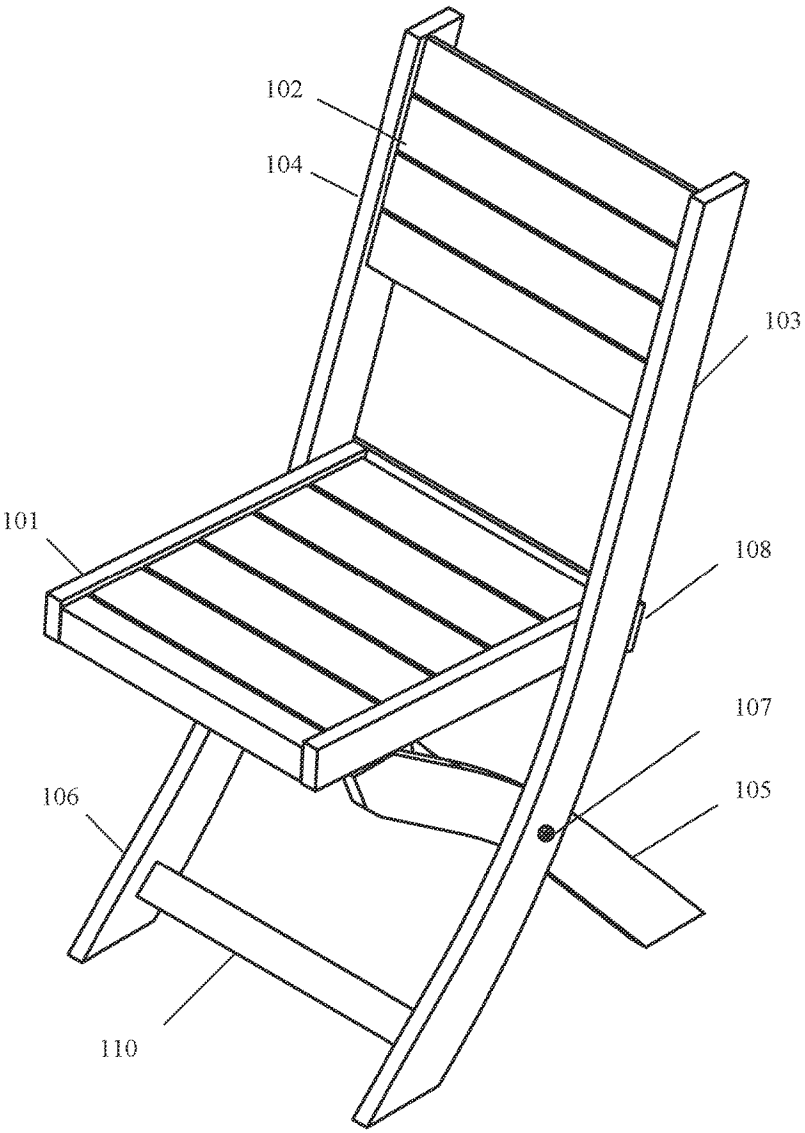
FIGS. 1A and 1B illustrate a front-angled view of an example folding chair in its unfolded position in some embodiments.

A folding chair is provided herein that is configurable in both a folded and unfolded position, wherein the folding chair can stand self-sufficiently on both its front and back legs while in the folded position. A folding chair in an embodiment comprises a first leg assembly comprising a first outer leg extending a length of the folding chair and a first inner leg pivotally coupled with the first outer leg, such that in the unfolded position, the first outer leg and first inner leg partially support the folding chair. The folding chair further comprises a second leg assembly comprising a second outer leg extending the length of the folding chair in parallel with the first outer leg and a second inner leg in parallel with the first inner leg and pivotally coupled with the second outer leg, such that in the unfolded position, the second outer leg and second inner leg partially support the folding chair. The folding chair also comprises a seat with a support member, wherein the seat is pivotally coupled to an upper end of each inner leg of the first inner leg and the second inner leg, such that in the unfolded position, the seat provides support for a person when the support member contacts a portion of the first outer leg and a portion of the second outer leg preventing overextension of the seat. The folding chair further comprises a chair back fixed between an upper portion of each upper leg of the first outer leg and the second outer leg.

In another embodiment, a folding chair in a folded position is provided. The folding chair comprises a first leg assembly comprising a first outer leg extending a length of the folding chair and a first inner leg pivotally coupled with the first outer leg, such that in the folded position, the first outer leg and first inner leg partially support the folding chair. The folding chair further comprises a second leg assembly comprising a second outer leg extending the length of the folding chair in parallel with the first outer leg and a second inner leg in parallel with the first inner leg and pivotally coupled with the second outer leg, such that in the folded position, the second outer leg and second inner leg partially support the folding chair. The folding chair also comprises a seat with a support member, wherein the seat is pivotally coupled to an upper end of each inner leg of the first inner leg and the second inner leg, such that in the folded position, the seat lies behind and in parallel with the first leg assembly and the second leg assembly and provides a counterweight to allow the folding chair to stand on the first leg assembly and the second leg assembly. The folding chair further comprises a chair back fixed between an upper portion of each upper leg of the first outer leg and the second outer leg.

In yet another embodiment, a method of operating a folding chair is provided. The method comprises unfolding the folding chair and folding the chair. Unfolding the folding chair comprises, from the folded position, pivotally separating a first outer leg from a first inner leg, pivotally separating a second outer leg from a second outer leg, and pivoting a seat from a resting position to a supporting position on top of the first inner leg and the second inner leg. Folding the folding chair comprises, from the unfolded position, joining the first outer leg and the first inner leg, joining the second outer leg and the second inner leg, and pivoting the seat from the supporting position through a gap between the first outer leg and the second outer leg to the resting position.

Advantageously, a folding chair described in the present disclosure provides a self-sufficient piece of furniture that foregoes the need for storage assemblies as it can stand using its own components to balance. Further, the folding chair design minimizes the number of components needed to function by including two single-piece front legs and two-single-piece front legs. The front legs, referring to the legs in front of the chair with respect to an individual sitting in the chair, do not connect to the seat like the back legs do with a hinging mechanism. Thus, the front legs may remain free of connection to the seat, reducing strain on the front legs.

Turning now to the figures, FIG. 1A illustrates a front-angled view of an exemplary folding chair in its unfolded position. The folding chair comprises seat 101, seatback 102, two front legs 103 and 104, two back legs 105 and 106, leg hinge 107, a seat bar 108, and a leg bar 110. In some embodiments, the folding chair may be made out of recycled plastic, plastic, wood, metal or an alloy, or some other material.

In its unfolded position, the folding chair of FIG. 1A provides support for a seated person. The chair has two front legs 103 and 104 joined with two back legs 105 and 106, respectively, that hold a seat 101 in place for a person to use. Front legs 103 and 104 can be two singular, curved legs that stretch from a rear portion of the chair towards the front-most portion at the base of the chair. Similarly, both back legs 105 and 106 can be singular, curved pieces positioned to support the front portion of seat 101 and the back-most part of the chair when a person is seated. Front leg 103 and back leg 105 can be affixed to each other via leg hinge 107 at an intersection point below seat 101. On another side of the chair, front leg 104 and back leg 106 can also be affixed to each other via another leg hinge (not pictured). Leg hinge 107 and the other hinge allows the sets of legs to open or come together during the unfolding and folding processes, respectively. The leg hinges can be a pin, locking mechanism, or the like. In some embodiments, the leg hinges are internal to each set of legs. In other embodiments, the leg hinges may be visible on the outside of front legs 103 and 104.

Seat 101 connects to back legs 105 and 106 via seat hinges (not shown in this figure). Like leg hinge 107, seat hinges can allow the folding and unfolding of the chair at seat 101. When unfolded as shown, front legs 103 and 104 contact seat 101 via seat bar 108, which can extend perpendicularly beyond seat 101, forming a "T" shape when viewed with respect to both seat bar 108 and seat 101. Seat bar 108 reaches the same width as the folding chair, or more precisely, to the outer edges of front legs 103 and 104. Seat bar 108 acts as a mechanism to prevent the folding chair from opening any further than designed to hold seat 101 in place, while it also allows the seat 101 to freely configure to a folded position. In other embodiments, upon opening the folding chair, the front legs 103 and 104 can be locked into place with seat 101 and/or seat bar 108 using a pin, locking mechanism, or the like.

In the unfolded position, seat 101 and back legs 105 and 106 can be separated by an air gap via the seat hinges. As a result, the seat hinges and/or seat bar 108 can directly bear the support of a person seated on seat 101. For further support, seatback 102 provides support for the back of a seated person. Seatback 102 is located between front legs 103 and 104 at the top of the folding chair. Additionally, leg bar 110 is held in place between front legs 103 and 104. In various embodiments, fewer or additional support bars or beams can be included in the folding chair design.

Figure 1B:
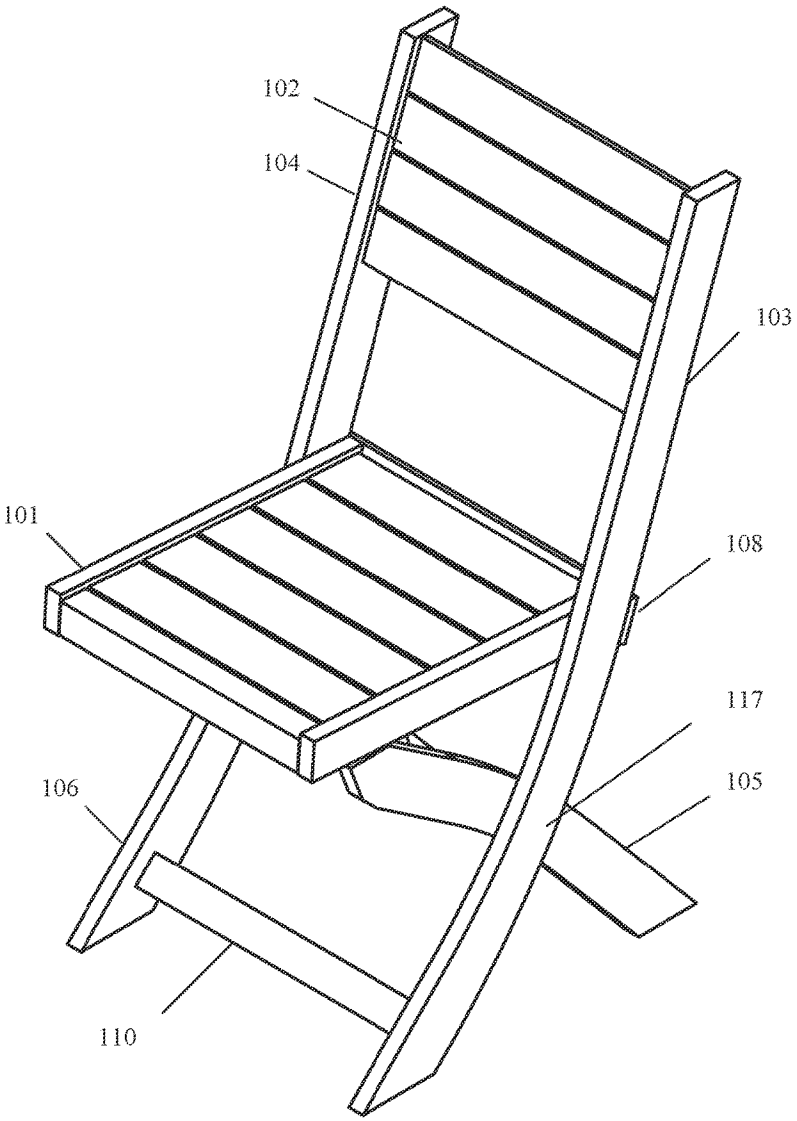

In some embodiments, such as the embodiment illustrated in FIG. 1B, leg hinge 117 may not be visible from the outside of the folding chair. For example, leg hinge 117 may include an internal pin, bolt, or the like, to keep the front and back legs together while maintaining aesthetics. Leg hinge 117 may function similarly to leg hinge 107, shown in FIG. 1A.

Figure 2:
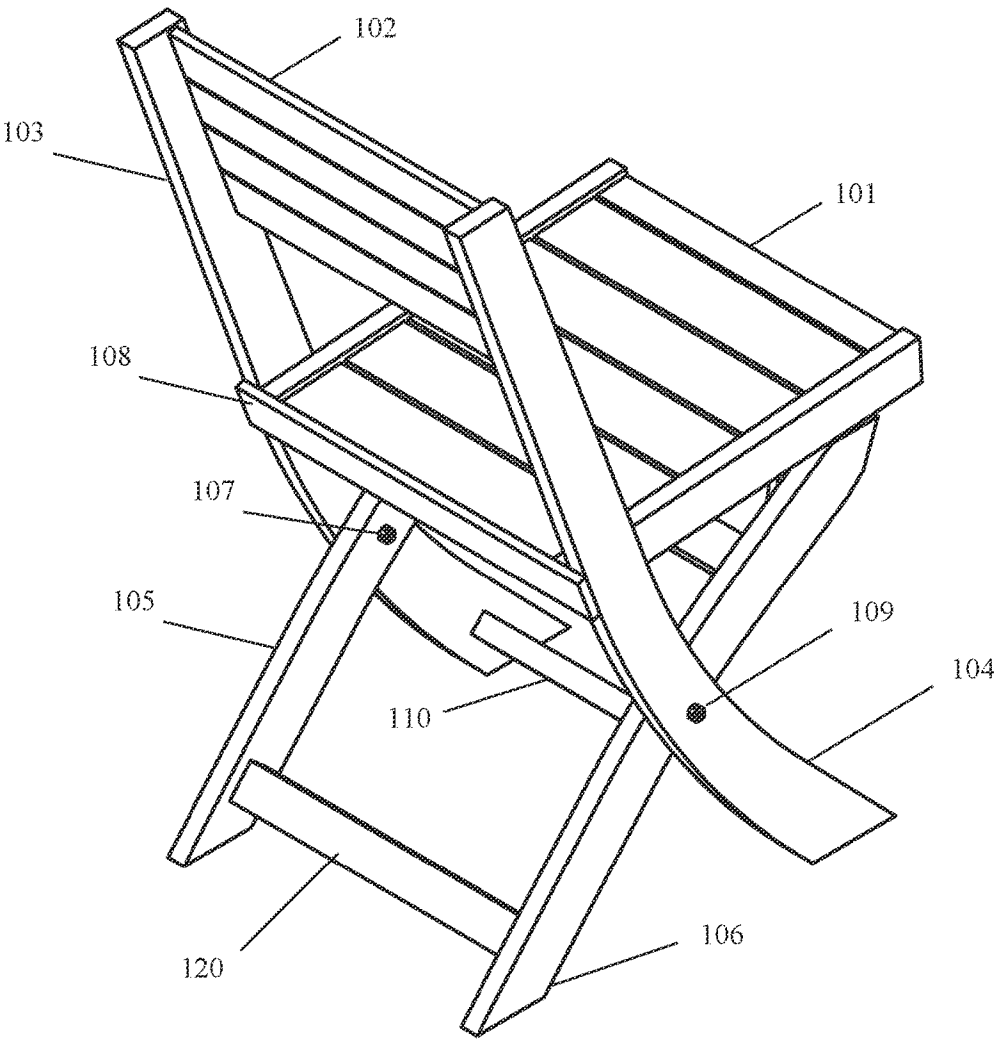
FIG. 2 illustrates a rear-angled view of an example folding chair in its unfolded position in some embodiments.

Moving to FIG. 2, this figure illustrates a rear-angled view of an exemplary folding chair in its unfolded position. FIG. 2 includes seat 101, seatback 102, front leg 103, front leg 104, back leg 105, back leg 106, leg hinge 107, leg hinge 109, seat bar 108, and leg bars 110 and 120. For example, the folding chair in FIG. 2 can exemplify the folding chair of FIGS. 1A and 1B and demonstrate additional members not shown in FIG. 1A, such as back leg bar 120 and leg hinge 109.

Like the folding chair of FIGS. 1A and 1B, the folding chair of FIG. 2 can provide support for a seated person. The chair has two front legs 103 and 104 joined with two back legs 105 and 106, respectively, that hold a seat 101 in place for a person to use. Front legs 103 and 104 can be two singular, curved legs that stretch from a rear portion of the chair towards the front-most portion at the base of the chair. Similarly, both back legs 105 and 106 can be singular, curved pieces positioned to support the front portion of seat 101 and the back-most part of the chair when a person is seated. Front leg 103 and back leg 105 can be affixed to each other via leg hinge 107 at an intersection point below seat 101. On another side of the chair, front leg 104 and back leg 106 can also be affixed to each other via leg hinge 109. Leg hinges 107 and 109 allow the sets of legs to open or come together during the unfolding and folding processes, respectively. The leg hinges can utilize a pin, locking mechanism, or the like. On the inside of back legs 105 and 106, leg hinges 107 and 109 can be held in place by a nut, bolt, or other fixture, respectively. In some embodiments, the leg hinges are internal to each set of legs.

Seat 101 connects to back legs 105 and 106 via seat hinges (not shown in this figure). Like leg hinges 107 and 109, seat hinges can allow for a rotation and/or change in position of seat 101 during folding and unfolding of the chair. When unfolded, front legs 103 and 104 contact seat 101 via seat bar 108, which can extend perpendicularly beyond seat 101, forming a "T" shape when viewed with respect to both seat bar 108 and seat 101. Seat bar 108 reaches the same width as the folding chair, or more precisely, to the outer edges of front legs 103 and 104. Seat bar 108 acts as a mechanism to prevent the folding chair from opening any further than designed to hold seat 101 in place. In other embodiments, upon opening the folding chair, the front legs 103 and 104 can be locked into place with seat 101 and/or seat bar 108 using a pin, locking mechanism, or the like.

In the unfolded position, seat 101 and back legs 105 and 106 can be separated by an air gap via the seat hinges. As a result, the seat hinges and/or seat bar 108 can directly bear the support of a person seated on seat 101. For further support, seatback 102 provides support for the back of a seated person. Seatback 102 is located between front legs 103 and 104 at the top of the folding chair. Leg bar 110 is held in place between front legs 103 and 104, and leg bar 120 is held in place between back legs 105 and 106. Both leg bars 110 and 120 can provide structural support for the folding chair while also maintaining support between the front legs and back legs, respectively. In various embodiments, fewer or additional support bars or beams can be included in the folding chair design.

Figure 3:
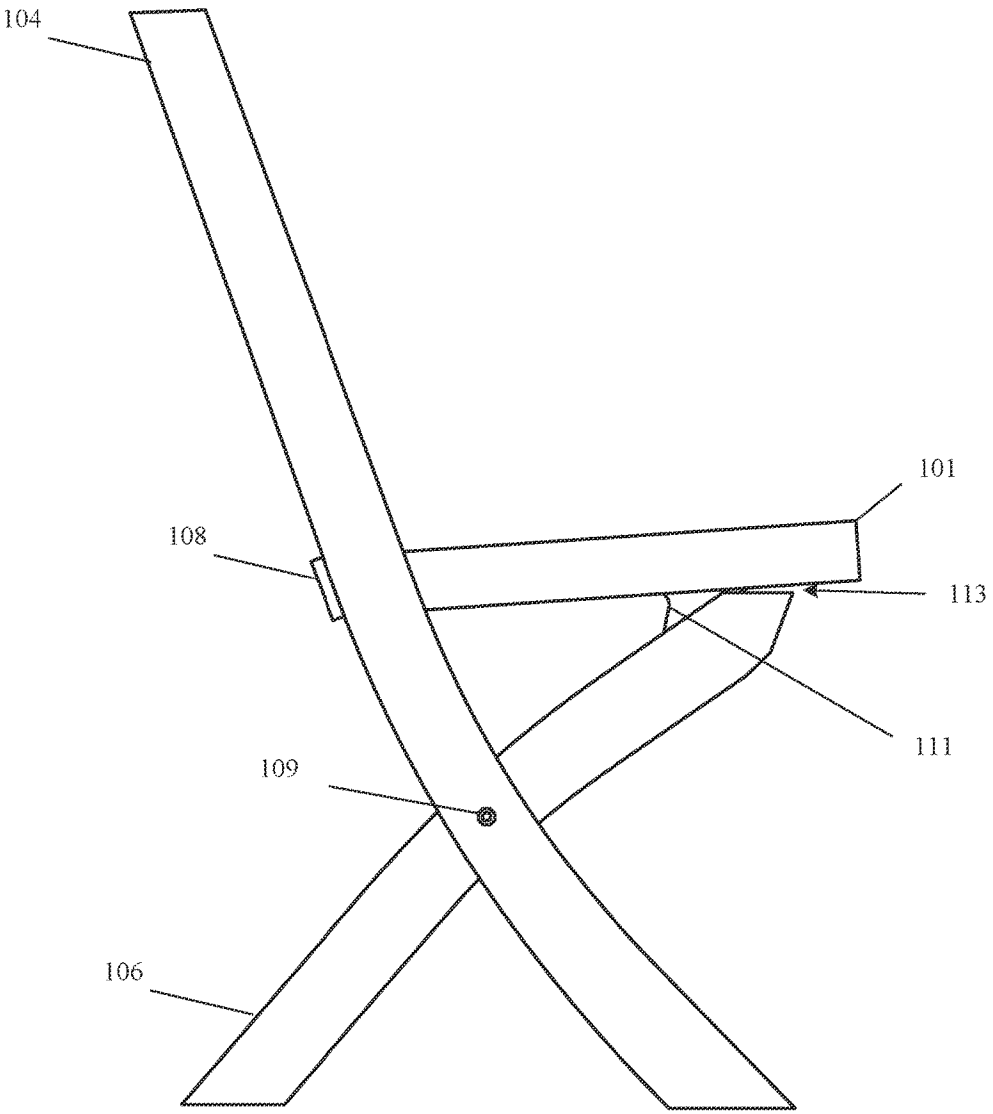
FIG. 3 illustrates a lateral view of an example folding chair in its unfolded position in some embodiments.

FIG. 3 illustrates a lateral view of an exemplary folding chair in its unfolded position. FIG. 3 demonstrates the folding chair described and illustrated in the preceding aspects, and it includes seat 101, front leg 104, back leg 106, seat bar 108, leg hinge 109, seat hinge 111, and seat gap 113.

In the unfolded position, seat 101 connects to back leg 106 via seat hinge 111. It may be appreciated that two seat hinges exist, yet only one is depicted in FIG. 3. Seat hinge 111 can allow for a rotation of seat 101. For example, when unfolding the chair, seat 101 can be lifted and/or rotated into position such that it lies nearly parallel to the ground in the unfolded position. In this position, seat 101 and seat hinge 111 can create a seat gap 113 such that seat 101 does not directly make contact with back leg 106. Rather, seat hinges, such as seat hinge 111 bears the force of a person towards the front of seat 101. Seat gap 113 can provide the benefit of allowing the seat 101 to fold through the front legs when the chair is being placed into the folded position. For further support, seat bar 108 can prevent seat 101 from at least making contact with back leg 106. Seat bar 108 can also take some pressure from the seated person to stabilize the folding chair.

In some embodiments, in order to fold the chair into its folded position, the seat hinges allows seat 101 to pivot and fold between the two front legs when seat 101 is pulled upward and pushed towards the space between the two front legs. Seat gap 113 provides the clearance required to accomplish the folding process because otherwise seat 101 does not overcome a supportive leg bar shown in a later figure. In this embodiment, due to seat gap 113, seat 101 does not make physical contact with either back leg 105 (shown in previous figures) or back leg 106 while in the unfolded position. Thus, the weight of an individual sitting on seat 101 is absorbed by at least seat hinge 111 and seat bar 108 by way of front legs 103 (shown in previous figures) and 104.

Seat 101 can, however, make contact with back legs 105 and 106 during the folding process. Seat 101 may be lifted up and pushed back towards the space between front legs 103 and 104 to initiate the folding process. After an initial lift, seat hinge 111 can pivot seat 101 to create a change in angle of seat 101 causing seat 101 to touch back legs 105 and 106 to complete the remainder of the folding process. At the same time, leg hinges 107 (not depicted here) and 109 allow front legs 103 and 104 and back legs 105 and 106 to remain connected while reducing the angle of separation between the legs, bringing the chair to a folded position.

It may be appreciated that in some embodiments that a seat gap, such as seat gap 113, may not exist, meaning that seat 101 makes contact with back legs 105 and 106 while in the unfolded position. Thus, back legs 105 and 106 may directly support the weight of an individual seated in the folding chair. In such embodiments, the chair may or may not include seat bar 108 depending on weight support requirements.

Figure 4:
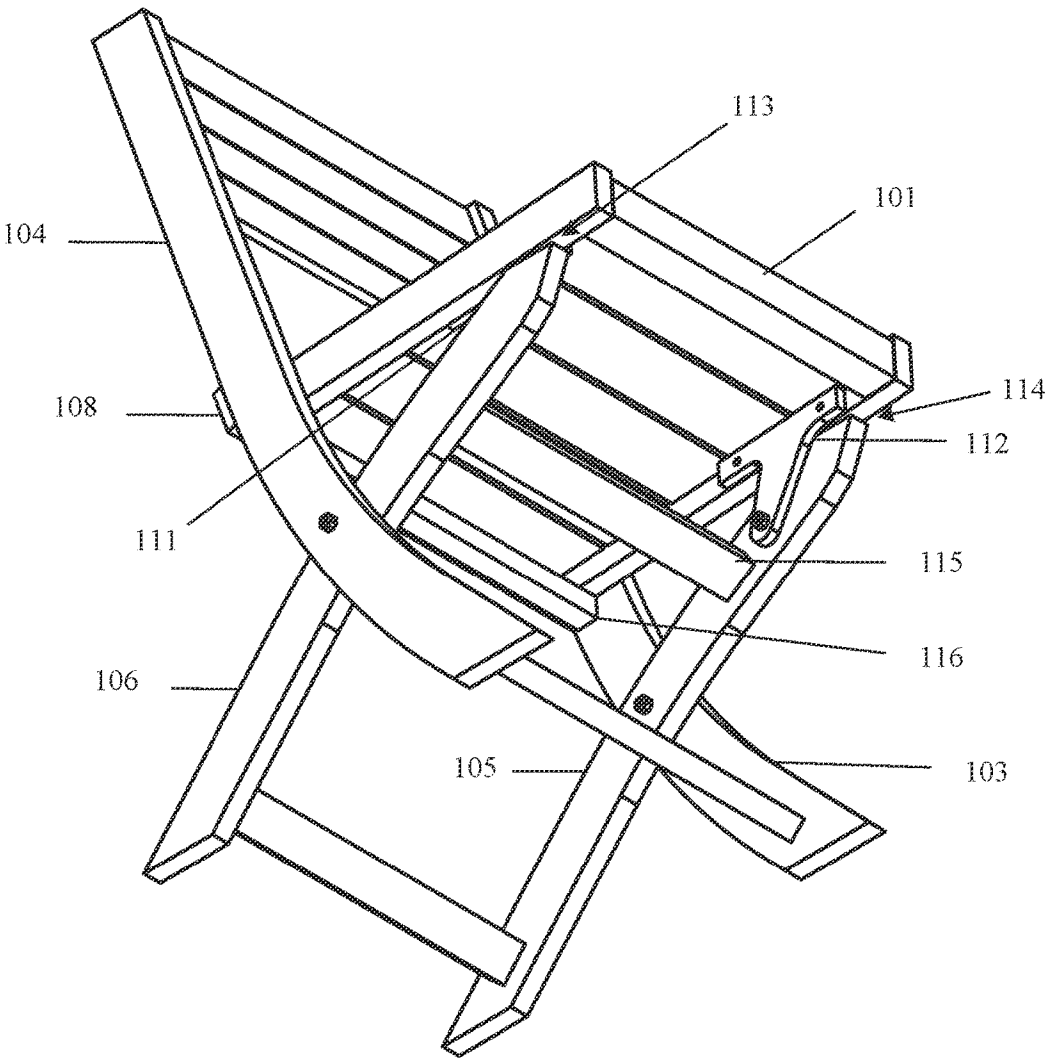
FIG. 4 illustrates a bottom-angled view of an example folding chair in its unfolded position in some embodiments.

FIG. 4 illustrates a bottom-angled view of an exemplary folding chair in its unfolded position. This illustration includes seat 101, front legs 103 and 104, back legs 105 and 106, seat bar 108, seat hinges 111 and 112, seat gaps 113 and 114, and upper leg bars 115 and 116. As such, FIG. 4 demonstrates further support pieces that may contribute to sturdiness and durability of the folding chair described herein.

Seat hinge 112 is fastened to seat 101 in at least one place on the under-side of seat 101 and to the inside of back legs 105. Similarly, seat hinge 111 comprises similar fastening points but on the inside of back leg 106. Upper leg bar 115 is held into place between both back legs 105 and 106. Likewise, upper leg bar 116 is held into place between both front legs 103 and 104. In addition to seat bar 108 and seat hinges 111 and 112, upper leg bar 116 may also support some of the weight of the individual seated in the folding chair in its unfolded position. The weight of the individual is thus distributed throughout the chair allowing for sturdiness and durability of the chair.

As illustrated by seat gaps 113 and 114, seat hinges 111 and 112 separate seat 101 from back legs 105 and 106, respectively, with enough space to clear upper leg bar 116 while performing the folding process of the folding chair. In some embodiments, seat gaps 113 and 114 are necessary to properly fold the folding chair because clearance is required to bypass a seat support bar, such as upper leg bar 116.

Figure 5:
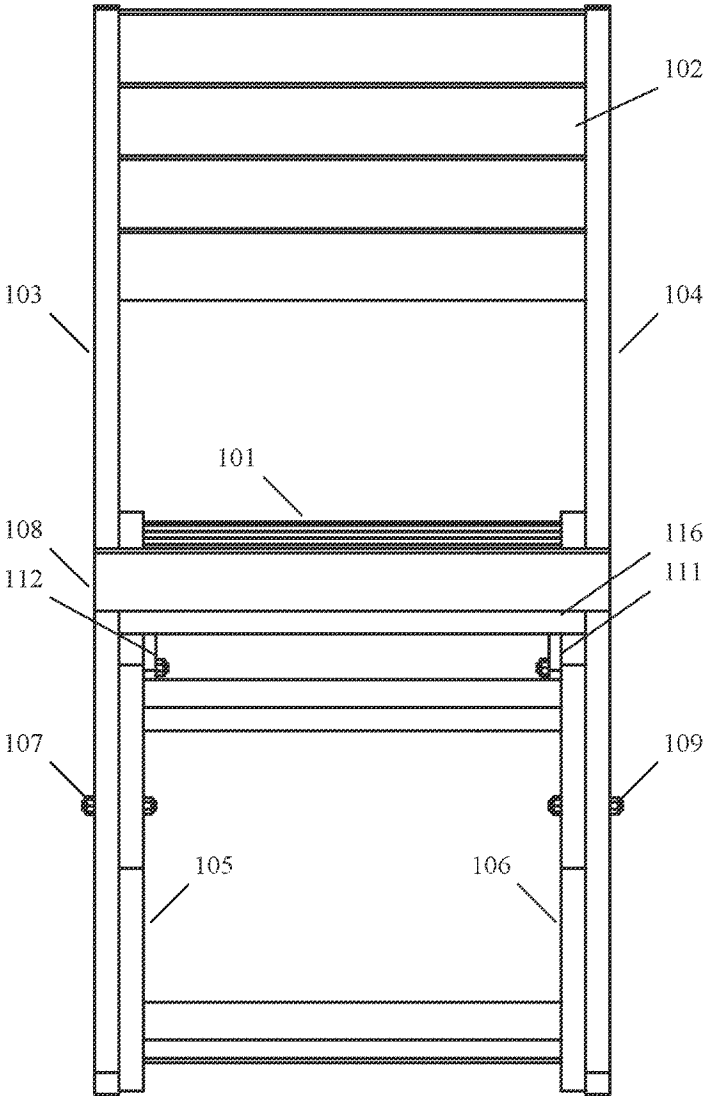
FIG. 5 illustrates a rear-view of an example folding chair in its unfolded position in some embodiments.

FIG. 5 illustrates a rear-view of an exemplary folding chair in its unfolded position. FIG. 5 includes seat 101, seatback 102, front legs 103 and 104, back legs 105 and 106, leg hinges 107 and 109, seat bar 108, seat hinges 111 and 112, and upper leg bar 116.

While unfolded, seat 101 can sit parallel with ground. However, in some embodiments, a gap may be created by seat hinges 111 and 112 that cause seat 101 to be lifted slightly. As seat 101 is lifted upwards from the seat hinges, it can be pushed towards the back of the chair and lifted over upper leg bar 116 in order to be folded. Meanwhile, seat hinges 107 and 109 can cause front legs 103 and 104 to move together with back legs 105 and 106, respectively, as the chair folds. Seat bar 108 can move farther away from each set of legs and lose contact with front legs 103 and 104 during the folding process. Once seat 101 has passed upper leg bar 116, it can pivot or rotate downwards with seat bar 108 moving towards the ground. Eventually, in the folded position, seat 101 can lie perpendicular to the ground and parallel to the folding chair's legs.

Figure 6:
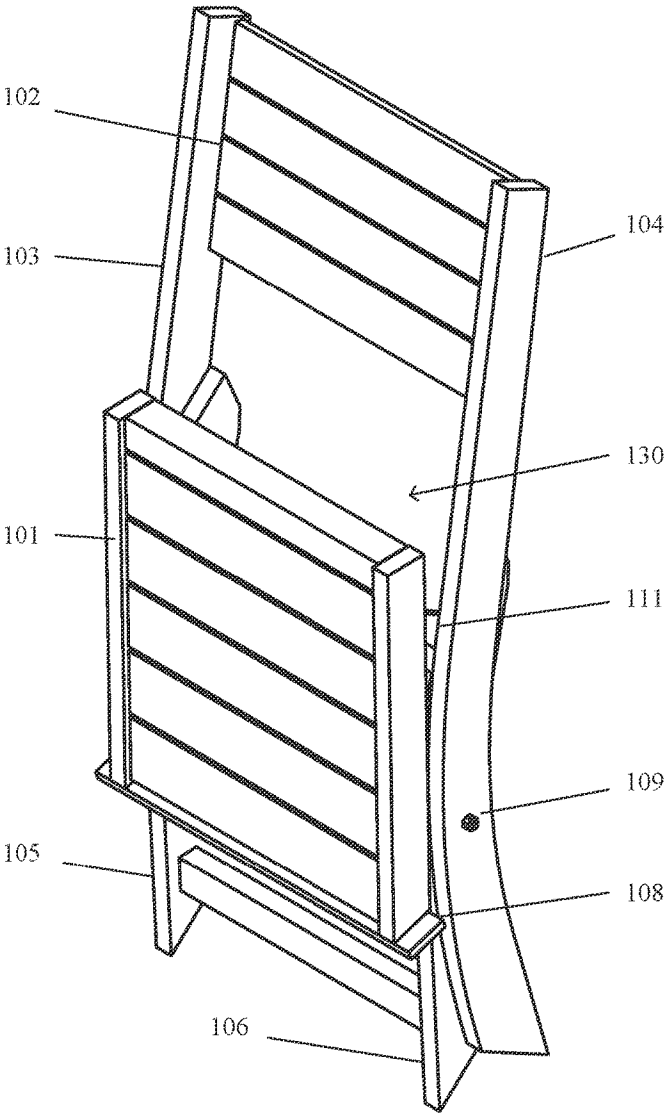
FIG. 6 illustrates a rear-angled view of an example folding chair in its folded position in some embodiments.

FIG. 6 illustrates a rear-angled view of an exemplary folding chair in its folded position. FIG. 6 includes seat 101, seatback 102, front legs 103 and 104, back legs 105 and 106, seat bar 108, leg hinge 109, seat hinge 111, and leg gap 130. In its folded position, seat 101 rests vertically behind both sets of front and back legs, and the sets of legs can allow the folding chair to support its own weight and stand on its own.

In a folded position, both sets of legs (i.e., front legs 103 and 104 and back legs 105 and 106) rest on the ground while the chair itself stands in an upright position. Front leg 103 and back leg 105 come together nearly in parallel wherein back leg 105 resides on the inside of front leg 103. Likewise, front leg 104 and back leg 106 come together nearly in parallel as well in the same formation as the other set of legs. This may be made possible because of leg hinge 109 and leg hinge 107 (shown in previous figures) that can keep a front leg affixed to a back leg and rotate about an axis. Due to at least the angle between each front and back leg in the folded position and a counterweight of seat 101, the folding chair can stand on its own. This allows for easy storage, stacking ease, and timely set up of multiple chairs.

Seat 101 may now sit perpendicularly with the ground and nearly in parallel with both sets of legs. Seat bar 108, connected to seat 101, can embody the back-most portion of seat 101 and it may lie closest to the ground with respect to the remainder of seat 101. At the other end of the chair, seatback 102 can be held in place between front leg 103 and front leg 104 towards the top of the folding chair.

Seat gap 130 is a space between both sets of legs below seatback 102. Seat gap 130 provides a space sufficiently large enough to allow seat 101 to be pushed or pulled through it. For example, seat 101 can be connected to back legs 105 and 106 via a seat hinge (not pictured in this figure) to allow rotation and movement of seat 101 through seat gap 130 to reach a folded or unfolded position.

To reach the folded position from the unfolded position, seat 101 may be lifted from its resting position and pushed through seat gap 130, seat bar 108 side first. Leg hinges 107 (not depicted here) and 109 keep both sets of legs connected while they close and come together during the folding process. As seat 101 progresses through seat gap 130, seat hinges 111 and 112 (not depicted here) can allow seat 101 to pivot or rotate downward into the position illustrated in FIG. 6.

Figure 7:
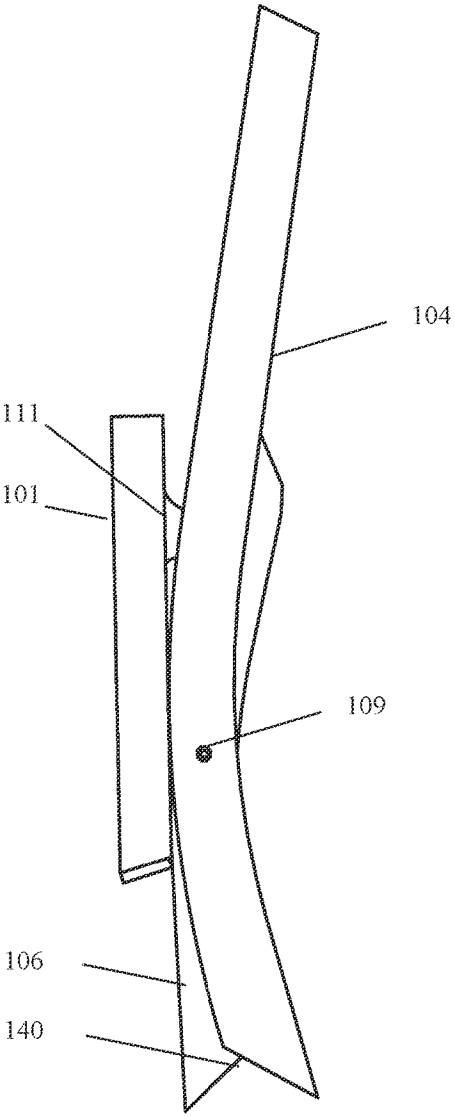
FIG. 7 illustrates a lateral view of an example folding chair in its folded position in some embodiments.

FIG. 7 illustrates a lateral view of an exemplary folding chair in its folded position. FIG. 7 includes seat 101, front leg 104, back leg 106, seat hinge 111, and leg angle 140. The folding chair may have a curved design which advantageously allows the legs to support its own weight due to counterweight of at least the seat and top portion of the front legs.

In various embodiments, seat 101 may rest on both front legs 103 (not depicted here) and 104 and back legs 105 (not depicted here) and 106. In the folded position, seat 101 rests completely behind both sets of legs. While back leg 106, for example, may partly protrude in front of front leg 104, with respect to the ground, it still sits behind front leg 104. In this position, front leg 103 and back leg 105 can come together nearly in parallel wherein back leg 105 resides on the inside of front leg 103. Likewise, front leg 104 and back leg 106 come together nearly in parallel as well in the same formation as the other set of legs. This may be made possible because of leg hinge 109 and leg hinge 107 (shown in previous figures) that can keep a front leg affixed to a back leg and rotate about an axis.

At the lowest point of each leg, an angle 140 is created between each front leg and back leg (i.e., front leg 104 and back leg 106). Because of at least angle 140 along with the counterweight of seat 101 and the curvature of each leg, the folding chair has the ability to stand on its own in the folded position. Advantageously, the folded chair can be easily stored, stacked, and the like.

Figure 8:
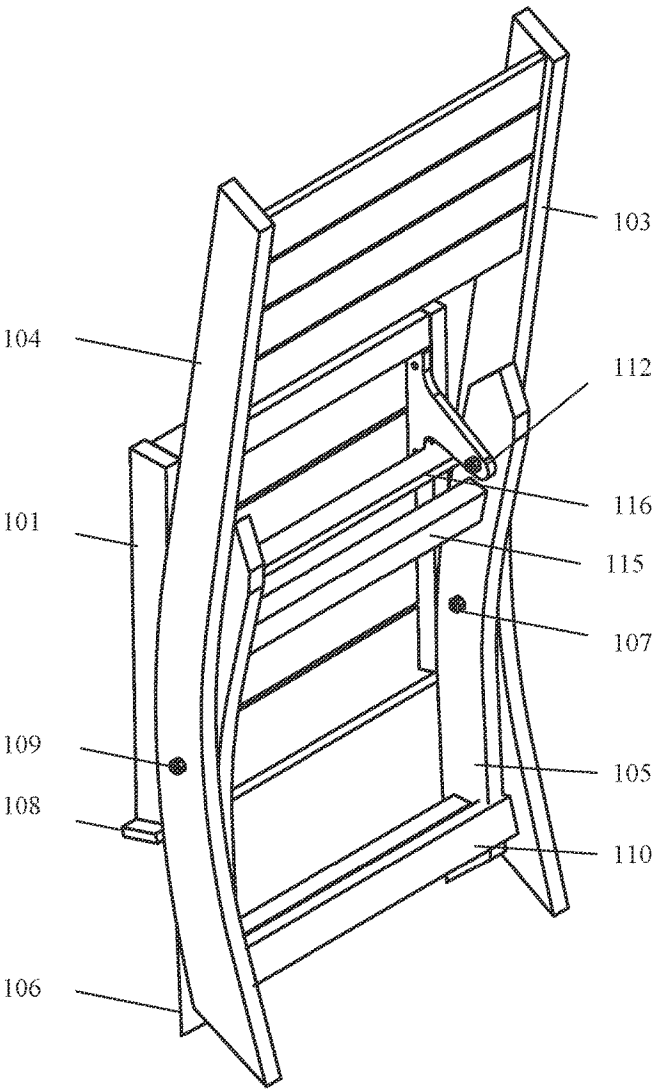
FIG. 8 illustrates a front-angled view of an example folding chair in its folded position in some embodiments.

FIG. 8 illustrates a front-angled view of an example folding chair in its folded position. FIG. 8 includes seat 101, front legs 103 and 104, back legs 105 and 106, leg hinges 107 and 109, seat bar 108, leg bar 110, seat hinge 112, and upper leg bars 115 and 116.

In the folded position, both sets of legs (i.e., front legs 103 and 104 and back legs 105 and 106) can rest on the ground while the chair itself stands in an upright position. Front leg 103 and back leg 105 come together nearly in parallel wherein back leg 105 resides on the inside of front leg 103. Likewise, front leg 104 and back leg 106 come together nearly in parallel as well in the same formation as the other set of legs. This may be made possible because of leg hinges 107 and 109 that can keep a front leg affixed to a back leg and rotate about an axis. Due to at least the angle between each front and back leg in the folded position and a counterweight of seat 101, the folding chair can stand on its own. This allows for easy storage, stacking ease, and timely set up of multiple chairs.

Seat hinge 112 is fastened to seat 101 in at least one place on the under-side of seat 101 and to the inside of back legs 105. Similarly, seat hinge 111 (shown in previous figures) comprises similar fastening points but on the inside of back leg 106. Seat hinges 111 and 112 allow seat 101 to rotate about on the back legs and fall vertically behind the legs of the chair which may make the chair compact for storage purposes. Upper leg bar 115 is held into place between both back legs 105 and 106. Likewise, upper leg bar 116 is held into place between both front legs 103 and 104. In addition to seat bar 108 and seat hinges 111 and 112, upper leg bar 116 may also support some of the weight of the individual seated in the folding chair in its unfolded position. The weight of the individual is thus distributed throughout the chair allowing for sturdiness and durability of the chair.

Leg bar 110 may touch both back leg 105 and 106 in the folded position and can prevent leg hinges 107 and 109 from allowing further rotation of the legs and folding the chair any further. Additionally, while seat 101 may rest on both back and front legs, seat hinges 111 and 112 make contact and rest on upper front leg bar 116 which prevents the seat from moving any further downward.

From the folded position, the chair may be unfolded by lifting seat 101 upward from seat bar 108 until it is parallel with the ground and pushing seat 101 forward between each set of legs while separating front legs 103 and 104 from back legs 105 and 106, respectively. Alternatively, either the front legs or back legs can be held in place while the other legs are pulled or pushed to a desired position and rotated using the leg hinges 107 and 109. Leg hinges 107 and 109 will allow back legs 105 and 106 to separate from front legs 103 and 104 and allow seat 101 to move forward along with the back legs 105 and 106. Seat 101 can be lifted an amount to bypass upper leg bar 116 and eventually rest on it once in unfolded position. Then, once again, the folding chair can be used by an individual in unfolded position.

In the folding furniture space, the present disclosure provides a sturdy, durable chair that folds easily, maintains a compact design, can be stacked easily, and can stand on its own while in the folded position. The ability to stand on its own allows individuals to store the folding chair without requiring a wall to lean the chair against or significant ground space to lie the chair down.

Unless the context clearly requires otherwise, throughout the description and the claims, the words "comprise," "comprising," "such as," and "the like" are to be construed in an inclusive sense, as opposed to an exclusive or exhaustive sense, that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the technology is not intended to be exhaustive or to limit the technology to the precise form disclosed above. While specific examples for the technology are described above for illustrative purposes, various equivalent modifications are possible within the scope of the technology, as those skilled in the relevant art will recognize. The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements.

These and other changes can be made to the technology in light of the above Detailed Description. While the above description describes certain examples of the technology, and describes the best mode contemplated, no matter how detailed the above appears in text, the technology can be practiced in many ways. Details of the system may vary considerably in its specific implementation, while still being encompassed by the technology disclosed herein. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim. Any claims intended to be treated under 35 U.S.C. § 112(f) will begin with the words "means for," but use of the term "for" in any other context is not intended to invoke treatment under 35 U.S.C. § 112(f). Accordingly, the applicant reserves the right to pursue additional claims after filing this application to pursue such additional claim forms, in either this application or in a continuing application.

What is claimed is:

1. A folding chair configurable in an unfolded position and a folded position, the folding chair in the unfolded position comprising:

a first leg assembly comprising:

a first outer leg extending a length of the folding chair; and a first inner leg pivotally coupled with the first outer leg, such that in the unfolded position, the first outer leg and the first inner leg partially support the folding chair;

a second leg assembly comprising:

a second outer leg extending the length of the folding chair in parallel with the first outer leg; and a second inner leg in parallel with the first inner leg and pivotally coupled with the second outer leg, such that in the unfolded position, the second outer leg and the second inner leg partially support the folding chair;

a seat comprising a support member, wherein the seat is pivotally coupled to an upper end of each inner leg of the first inner leg and the second inner leg by individual ones of seat hinges, such that in the unfolded position, the seat provides support for a person when the support member contacts a portion of the first outer leg and a portion of the second outer leg preventing overextension of the seat, and the seat hinges create an air gap between the seat and the first inner leg and the second inner leg, wherein the air gap is configured to provide a clearance space, when folding the folding chair to the folded position, between the seat and an internal support bar positioned between a middle portion of each outer leg of the first outer leg and the second outer leg; and a chair back fixed between an upper portion of each outer leg of the first outer leg and the second outer leg.

2. The folding chair of claim 1, wherein the seat hinges are configured to provide rotation of the seat about an axis, wherein one seat hinge affixes the seat to the first inner leg and a second seat hinge affixes the seat to the second inner leg.

3. The folding chair of claim 1, wherein, in the unfolded position, the air gap is further configured to allow the seat hinges to bear at least a portion of the support provided by the seat.

4. The folding chair of claim 1, wherein the support member is affixed to a rear portion of the seat and extends the width of the folding chair.

5. The folding chair of claim 1, further comprising an internal support structure including one or more leg bars affixed between the first leg assembly and the second leg assembly under the seat.

6. The folding chair of claim 1, wherein the seat further comprises a locking mechanism configured to hold the seat between each leg assembly of the first leg assembly and the second leg assembly while in the unfolded position.

7. The folding chair of claim 1, wherein the folding chair is made of recycled plastic.

8. A folding chair configurable in an unfolded position and a folded position, the folding chair in the folded position comprising:

a first leg assembly comprising:

a first outer leg extending a length of the folding chair; and a first inner leg pivotally coupled with the first outer leg, such that in the folded position, the first outer leg and the first inner leg partially support the folding chair;

a second leg assembly comprising:

a second outer leg extending the length of the folding chair in parallel with the first outer leg; and a second inner leg in parallel with the first inner leg and pivotally coupled with the second outer leg, such that in the folded position, the second outer leg and the second inner leg partially support the folding chair;

a seat comprising a support member, wherein the seat is pivotally coupled to an upper end of each inner leg of the first inner leg and the second inner leg by individual ones of seat hinges that create an air gap between the seat and each inner leg to provide a clearance space allowing the seat to avoid contact with an internal support bar positioned between a middle portion of each outer leg of the first outer leg and the second outer leg when folding the folding chair to the folded position, such that in the folded position, the seat lies behind and in parallel with the first leg assembly and the second leg assembly and provides a counterweight to allow the folding chair to stand on the first leg assembly and the second leg assembly; and a chair back fixed between an upper portion of each outer leg of the first outer leg and the second outer leg.

9. The folding chair of claim 8, wherein the seat hinges are configured to provide rotation of the seat about an axis, wherein one seat hinge affixes the seat to the first inner leg and a second seat hinge affixes the seat to the second inner leg.

10. The folding chair of claim 8, wherein the support member is affixed to a rear portion of the seat and extends the width of the folding chair.

11. The folding chair of claim 8, further comprising an internal support structure including one or more leg bars affixed between the first leg assembly and the second leg assembly under the seat.

12. The folding chair of claim 8, wherein, in the folded position, the first outer leg and the first inner leg create an angled base at a lowest portion of the first leg assembly to partially support the folding chair.

13. The folding chair of claim 8, wherein, in the folded position, the second outer leg and the second inner leg create an angled base at a lowest portion of the second leg assembly to partially support the folding chair.

14. The folding chair of claim 8, wherein the folding chair is made of recycled plastic.

15. A method of operating a folding chair, comprising:

unfolding the folding chair, wherein unfolding the folding chair comprises:

pivotally separating a first outer leg from a first inner leg;

pivotally separating a second outer leg from a second inner leg; and pivoting a seat from a resting position to a supporting position on top of the first inner leg and the second inner leg, wherein, in the supporting position, the seat is separated from the first inner leg and the second inner leg by an air gap created by individual ones of seat hinges; and folding the folding chair, wherein folding the folding chair comprises:

joining the first outer leg and the first inner leg;

joining the second outer leg and the second inner leg; and pivoting the seat from the supporting position through a gap between the first outer leg and the second outer leg and over an internal support bar positioned between a middle portion of each outer leg of the first outer leg and the second outer leg to the resting position.

16. The method of claim 15, further comprising standing the folding chair upright on the first outer leg and first inner leg and second outer leg and second inner leg.

17. The method of claim 15, wherein unfolding the folding chair further comprises rotating the seat about an axis via the seat hinges and lifting the seat above the internal support bar.

18. The method of claim 15, wherein folding the folding chair further comprises rotating the seat about an axis via the seat hinges and lifting the seat above the internal support bar.

19. The method of claim 15, wherein the supporting position provides support for a seated individual on the folding chair.

20. The method of claim 15, wherein the folding chair is made of a recycled plastic.

* * * * *